US005704807A

United States Patent [19]

Sherman et al.

[11] Patent Number: 5,704,807

[45] Date of Patent: Jan. 6, 1998

[54] SURFACE MOUNTABLE RETENTION BRACKET FOR ELECTRICAL CONNECTORS

[75] Inventors: Melissa Ann Sherman, Camp Hill; James Lee Fedder, Etters, both of Pa.

[73] Assignee: The Whitaker Corporation, Wilmington, Del.

[21] Appl. No.: 827,756

[22] Filed: Apr. 11, 1997

Related U.S. Application Data

[63] Continuation of Ser. No. 570,027, Dec. 11, 1995, abandoned.

[51] Int. Cl.[6] ..... H01R 13/73

[52] U.S. Cl. ..... 439/570

[58] Field of Search ..... 439/570, 571, 439/64

[56] References Cited

U.S. PATENT DOCUMENTS

| | | | |
|---|---|---|---|
| 3,601,770 | 8/1971 | Bowley | 339/125 R |
| 4,025,147 | 5/1977 | Van Arsdale et al. | 339/176 MP |
| 4,629,278 | 12/1986 | Norton et al. | 339/134 |
| 4,907,987 | 3/1990 | Douty et al. | 439/571 |
| 5,096,440 | 3/1992 | Katsumata | 439/570 |
| 5,133,670 | 7/1992 | Doi et al. | 439/79 |
| 5,145,386 | 9/1992 | Berg et al. | 439/83 |
| 5,186,654 | 2/1993 | Enomoto et al. | 439/570 |
| 5,188,535 | 2/1993 | Bertho et al. | 439/83 |
| 5,228,873 | 7/1993 | Hirai | 439/607 |
| 5,232,379 | 8/1993 | Lai | 439/570 |
| 5,259,789 | 11/1993 | Patel et al. | 439/570 |
| 5,297,966 | 3/1994 | Brennian, Jr. et al. | 439/64 |
| 5,385,478 | 1/1995 | Niekawa | 439/67 |
| 5,445,529 | 8/1995 | Yamamoto | 439/81 |

FOREIGN PATENT DOCUMENTS

| | | | |
|---|---|---|---|
| WO 93 02489 A | 2/1993 | WIPO | H01R 13/639 |

OTHER PUBLICATIONS

International Search Report mailed Mar. 14, 1997, PCT/US96/19623, three pages.

*Primary Examiner*—Neil Abrams
*Assistant Examiner*—Eugene G. Byrd

[57] ABSTRACT

A surface mountable retention bracket (40) for a connector assembly (10) having a housing (12) with outwardly extending mounting flanges (22), each flange (22) including two channels (26) extending therethrough to a mounting face (16), the channels (26) defining a retention tab (28) therebetween. The bracket (40) includes a base (42) securable to a circuit board (60); a pair of struts (44) extending upwardly from the base (42), the struts (44) being joined by a body section (46), the base (42), struts (44) and body section (46) together defining an opening (48) adapted to cooperate with the flange (22) to hold the bracket (40) on the housing (12). The struts (44) are bent intermediate the base (42) and the body section (46) such that the base (42) and the body section (46) are essentially at a right angle to each other. Upon inserting the bracket (40) into the channels (26) of the flange (22) and the retention tab (28) into the bracket opening (48), the retention bracket (40) is held in the housing (12) and in position for being soldered to the surface of the circuit board (60).

6 Claims, 4 Drawing Sheets

SURFACE MOUNTABLE RETENTION BRACKET FOR ELECTRICAL CONNECTORS

This application is a Continuation of application Ser. No. 08/570,027 filed Dec. 11, 1995, now abandoned.

FIELD OF THE INVENTION

This invention relates to electrical connectors and more particularly to surface mountable electrical connectors.

BACKGROUND OF THE INVENTION

When surface mounting electrical connectors to circuit boards, the increased miniaturization of the connectors and increased density of the terminals therein require that the connector housing be secured to the circuit board to provide strain relief for the multiple soldered terminal connections. One typical method of providing strain relief has been to use "board locks" or mounting pegs that extend through apertures in the circuit board. The increased complexity of electric equipment, however, often requires that connectors be mounted on both sides of a circuit board. Additionally, when stacking arrangements of parallel boards are required, the presence of board locks extending through the boards interferes with mounting other components in the assembly as well as consumes valuable "real estate" on the boards. It is desirable, therefore, to have surface mounted retention brackets to secure the connector to the board and to minimize the amount of space required for the bracket. It is also desirable that the retention or mounting brackets be configured to optimize the size of the solder fillet on the board to provide a secure attachment, particularly when the connectors are unmated.

SUMMARY OF THE INVENTION

The present invention is directed to an improved surface mountable holddown that minimizes stresses on terminal solder connections particularly during the unmating of the connector. The surface mountable electrical connector includes a housing having mating and mounting faces, opposed sidewalls and endwalls and at least one outwardly extending mounting flange extending outwardly along the mounting face thereof. The mounting flange includes at least two channels extending therethrough to the mounting face, the channels defining a retention tab therebetween. The channels and the tab are configured to receive struts of the retention bracket with the opening being disposed around the tab. The surface mountable retention bracket includes a base securable to an electrical article, such as a circuit board and a pair of struts extending upwardly from the base and joined together by a body section. The base, struts and body section together surround an opening adapted to cooperate with the flange to hold the bracket in the flange. The struts are bent intermediate the base and body section such that the base and body section are essentially at a right angle to each other. Upon inserting the bracket into the channels and the retention tab into the holder opening, the retention bracket is held in and to the mounting flange and in position for being soldered to the surface of the electrical article.

The base of the bracket is configured to provide a relatively large surface area for securing to a pad on the circuit board, thus adding to the stability of the connector and increasing resistance when the connector is unmated. Furthermore, the opening in the retention bracket provides a stop surface proximate each of the ends of the housing that helps to hold the connector to the board.

An embodiment of the invention will now be described by way of example with reference to the accompanying drawings.

DETAILED DESCRIPTION OF THE INVENTION

Figure 1:
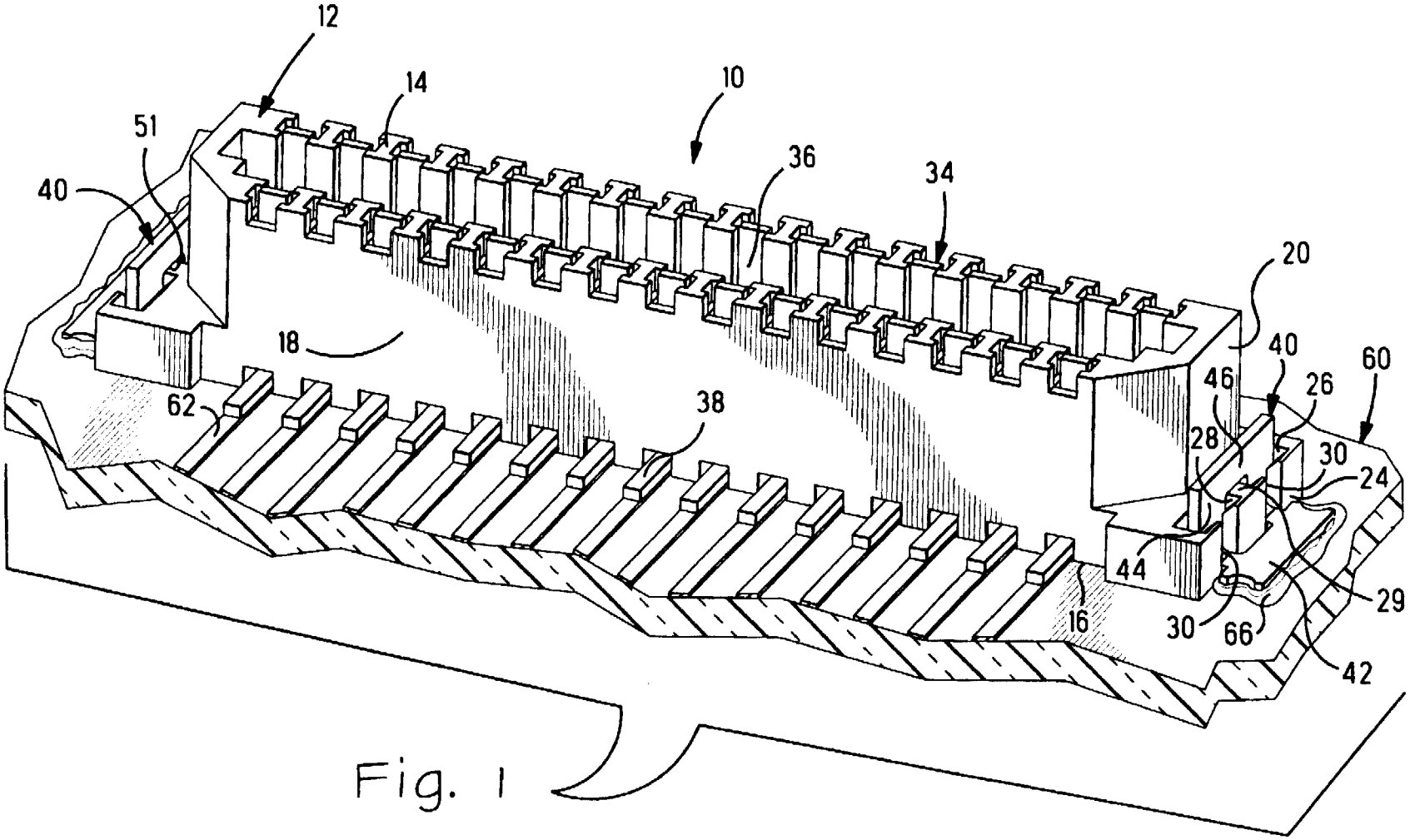
FIG. 1 is a perspective view of a surface mountable connector made in accordance with the invention mounted to a circuit board.
Figure 2:
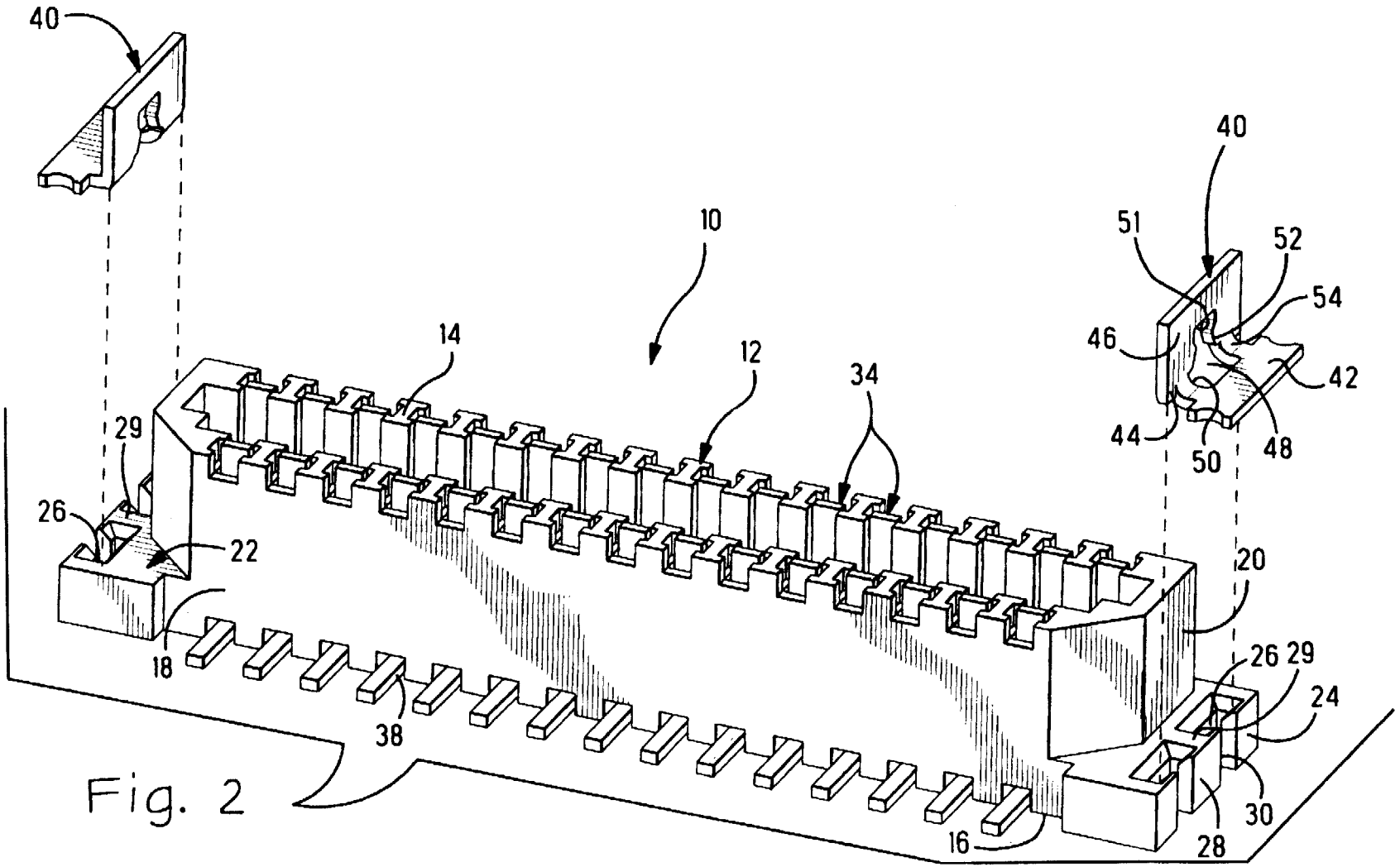
FIG. 2 is a perspective view of a connector of FIG. 1 with the retention bracket exploded from the mounting flange of the connector.
Figure 3:
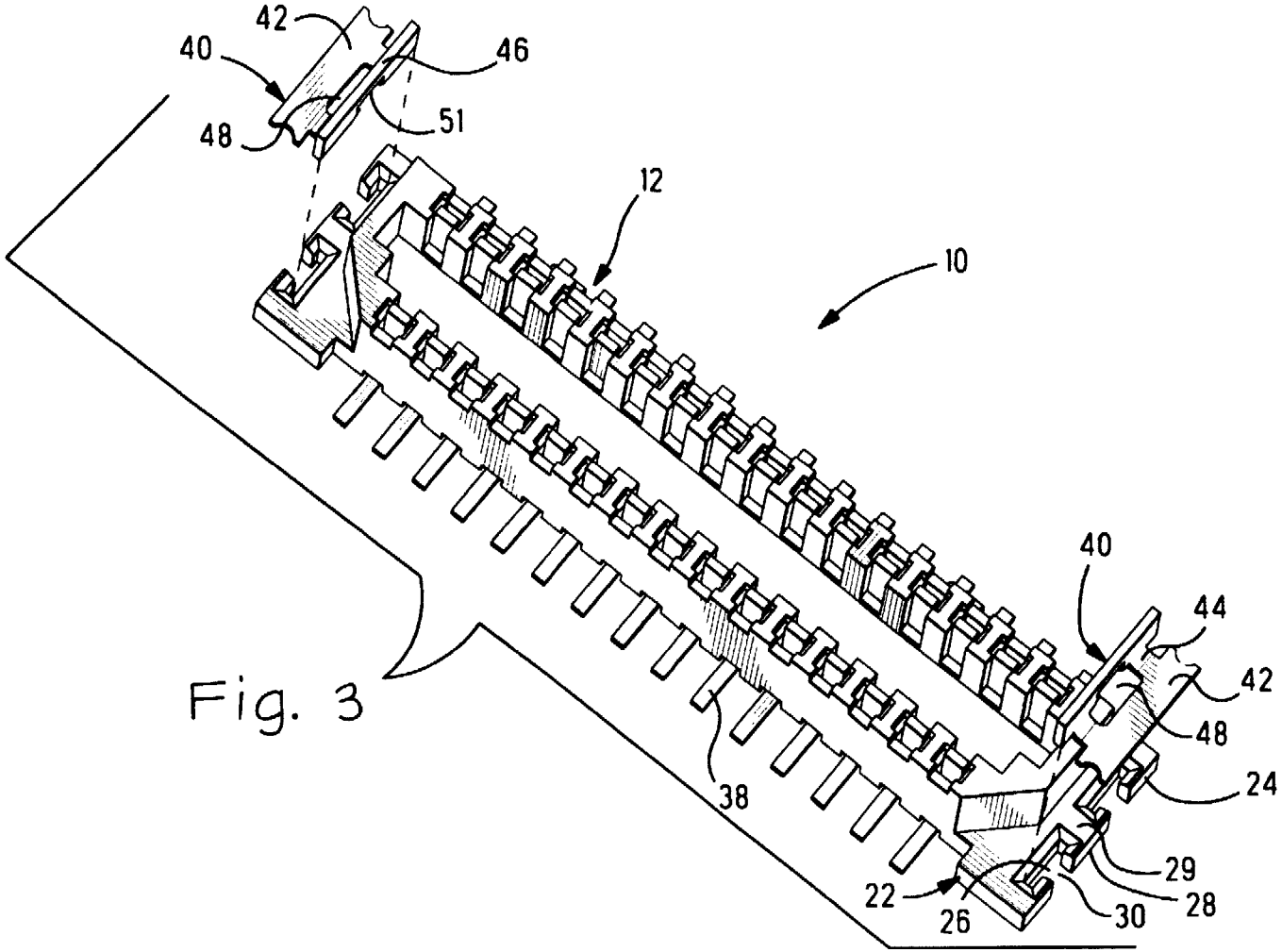
FIG. 3 is a view similar to that of FIG. 2.
Figure 4:
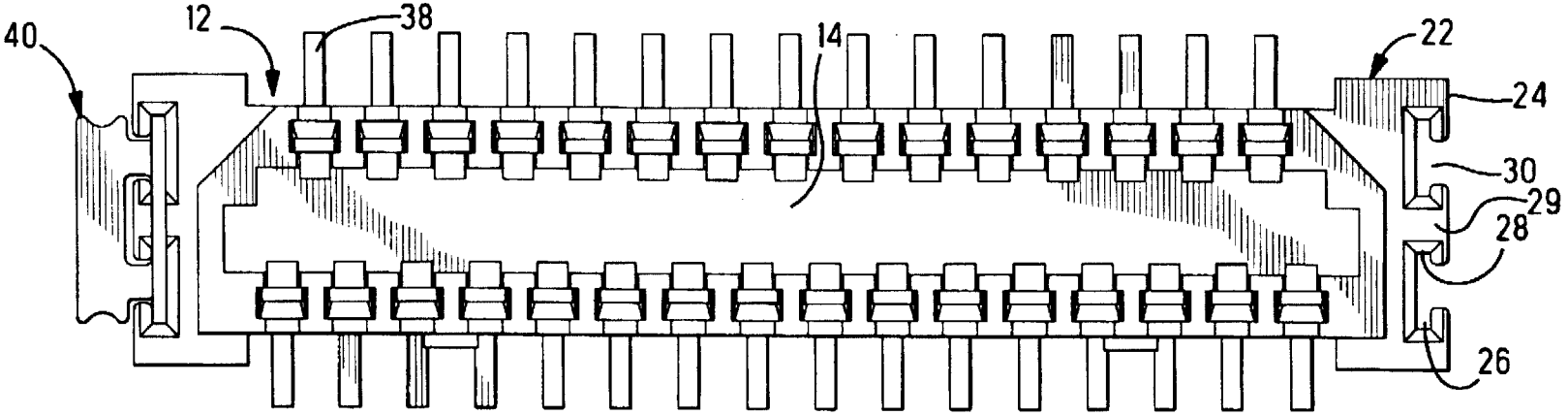
FIG. 4 is a top plan view of the connector of FIG. 1 with a retention bracket secured in one of two mounting flanges.
Figure 7:
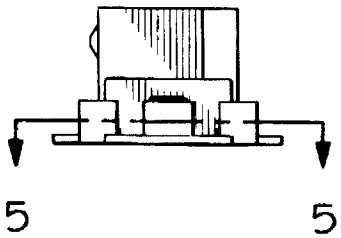
FIG. 7 is an end view of the assembled connector of FIG. 1.
Figure 6:
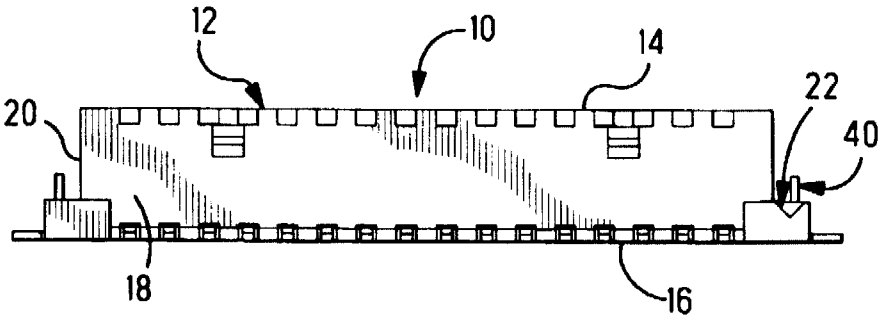
FIG. 6 is a side view of the assembled connector of FIG. 1.

For purposes of illustrating the invention the surface mountable retention bracket is shown being used to mount a receptacle connector having surface mount contacts therein. Referring now to FIG. 1 through 7, connector assembly 10 includes a housing 12 having mounting flanges 22 and retention brackets or holddowns 40 positioned within mounting flanges 22. The housing 12 has a mating face 14, a mounting face 16, opposed sidewalls 18, and opposed endwalls 20, each having a mounting flange 22 extending outwardly therefrom. As shown in FIGS. 1 through 4, mounting flange 22 includes a pair of flange-receiving channels 26 extending from the top surface thereof to the mounting face 16 of the housing 12. The channels 26 are spaced apart by a retention tab 28 having a top surface 29. The retention tab has a vertical neck between the channels and extends outwardly to an enlarged end portion. The outer wall 24 includes openings 30 therein which extend into the respective flange receiving channels 26. The connector assembly 10 further includes a plurality of terminals 34 mounted therein having first contact sections 36 exposed at the mating face 14 of the respectable and surface mount contact section 38 extending outwardly from the sidewalls 18 at the mounting face 16.

Figure 5:
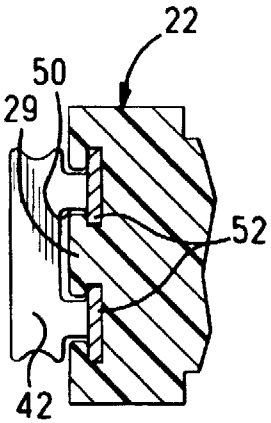
FIG. 5 is a sectional view taken along line 5—5 of FIG. 7.

Retention bracket 40 includes a base 42 having a pair of struts 44 extending upwardly to a body section 46 defining therebetween an opening 48, configured to receive and cooperate with the retention tab 28 of the flange 22 when retention bracket 40 is assembled to the connector housing 12. The opening has a narrow vertical portion along the body section and a wide horizontal portion adjacent the base. Retention bracket 40 further includes retention barbs 52 extending inwardly along the inner surface 50 of the opening 48 dimensioned to engage retention tab 28 in an interference fit, as best seen in FIG. 5. As shown in the FIGS. 1 through 4, the struts 44 of retention bracket 40 are bent intermediate the base 42 and the body section 46 to form a bend at 54 such that the base 42 and the body section 46 are at right angles to each other.

The retention bracket 40 is preferably stamped from a flat strip of material such as a pre-plated brass or other suitable metal with the base having a layer of tin/lead to increase solderability of the base to a circuit board. The retention bracket 40 is then formed at a right angle prior to inserting into the flange 22 of the connector housing 12. As can be seen from FIGS. 2 and 3, retention bracket 40 is inserted onto the connector flange 22 from the top surface 29 thereof with the opening 48 being disposed over the retention tab 28 in an interference fit, with the retention barbs 52 gripping the surfaces of the tabs 28 as best seen in FIG. 5. The horizontal opening portion permits passage of the enlarged end portion therethrough and the vertical opening receives therealong the neck of the retention tab thereby holding the bracket in and to the housings.

FIG. 1 shows connector assembly 10 mounted to a circuit board 60 having plurality of traces 62 thereon in electrical engagement with the surface mount contact sections 38 and base 42 of retention bracket 40 soldered at 66 to pads (not shown) on the circuit board 60. As can be seen from FIG. 1, the base 42 of the bracket 40 is configured to provide a relatively large surface area immediately adjacent the ends of the connector housing 12 for securing to the circuit board 60, thus adding to the side-to-side and end-to-end stability of the connector assembly 10. Furthermore, the opening in the retention bracket provides a stop surface 51 proximate each of the ends of the housing 12 that engages the top surface 29 of retention tab 28 to provide additional mechanical support to hold the connector 10 to the board when the connector 10 is being unmated.

The retention bracket of the present invention provides a cost effective secure holddown for electrical connectors. The bracket is loaded into the connector housing from the top surface, thereby making the bracket advantageous to use in automated assembly processes that insert terminals into housings from the top surface thereof. The bracket is also particularly suitable for use with high density miniaturized connectors. The bracket, being surface mounted, does not interfere with placement of other components on the opposite side of the circuit board.

It is thought that the retention bracket of the present invention and many of its attendant advantages will be understood from the foregoing description. It is apparent that various exchanges may be made in the form, construction, and arrangement of parts thereof without departing from the spirit or scope of the invention, or sacrificing all of its material advantages.

We claim:

1. A surface mountable retention bracket for use in a connector assembly having a housing with outwardly extending mounting flanges along a mounting face thereof, each said flange including two vertical channels extending therethrough to said mounting face, said channels defining a retention tab therebetween, said retention tab having a vertical neck between said channels and extending outwardly to an enlarged end portion, said retention bracket comprising:

a base securable to an electrical article, a pair of struts extending upwardly from said base, said struts being joined by a body section, said struts being bent intermediate said base and said body section such that said base and said body section are essentially at a right angle to each other, said base, struts and body section together surrounding an opening, said opening having a narrow vertical portion along said body section and a wide horizontal portion adjacent said base so that said opening is adapted to cooperate with said flange to hold said bracket on said housing;

whereby upon inserting one said bracket into said channels of each said flange of said connector from a position proximate said bracket base, said horizontal opening portion permits passage of said enlarged end portion therethrough and said vertical opening portion receives therealong said neck of said retention tab thereby holding said retention bracket in and to said housing and in position for being soldered to said surface of said electrical article.

2. The retention bracket of claim 1 wherein said struts further include at least one retention barb extending into said bracket opening for securing said bracket to said housing retention tab.

3. The retention bracket of claim 1 wherein said body section includes a stop surface within said vertical opening portion engageable with a top surface of said retention tab to provide mechanical support to hold said housing to said electrical article when the connector is unmated from a complementary connector.

4. A surface mountable connector assembly comprising:

a housing having mating and mounting faces and mounting flanges extending outwardly from endwalls thereof and along the mounting face, said housing including a plurality of terminals therein having surface mountable contact portions extending outwardly along the mounting face and adapted to engage circuits of an electrical article; and a surface mountable retention bracket disposed in each of said flanges;

each said flange including two channels extending vertically therethrough to said mounting face, said channels defining a retention tab therebetween, said retention tab having a vertical neck between said channels and extending outwardly to an enlarged end portion;

each said bracket including: a base securable to said electrical article, a pair of struts extending upwardly from said base, said struts being joined by a body section, said struts being bent intermediate said base and said body section such that said base and said body section are essentially at a right angle to each other, said base, struts and body section together surrounding an opening, said opening having a narrow vertical portion along said body section and a wide horizontal portion adjacent said base so that said opening is adapted to cooperate with said flange to hold said bracket on said housing;

whereby upon inserting one said bracket into said channels of each said flange of said connector from a position proximate said bracket base, said horizontal opening portion permits passage of said enlarged end portion therethrough and said vertical opening portion receives therealong said neck of said retention tab thereby holding said retention bracket in said housing and in position for being soldered to said surface of said electrical article.

5. The surface mountable connector assembly of claim 4 wherein said struts further include at least one retention barb extending into said bracket opening for securing said bracket to said housing retention tab.

6. The surface mountable connector assembly of claim 4 wherein said body section includes a stop surface within said vertical opening portion engageable with a top surface of said retention tab to provide mechanical support to hold said housing to said board when the connector is unmated from a complementary connector.

* * * * *